US007527160B2

(12) United States Patent
Shingle

(10) Patent No.: US 7,527,160 B2
(45) Date of Patent: May 5, 2009

(54) CLOSURE HAVING USER-MODIFIABLE FUNCTIONALITY

(75) Inventor: John M. Shingle, Perrysburg, OH (US)

(73) Assignee: Rexam Prescription Products Inc., Perrysburg, OH (US)

( * ) Notice: Subject to any disclaimer, the term of this patent is extended or adjusted under 35 U.S.C. 154(b) by 878 days.

(21) Appl. No.: 10/682,608

(22) Filed: Oct. 9, 2003

(65) Prior Publication Data

US 2005/0103741 A1 May 19, 2005

(51) Int. Cl.
*B65D 39/00* (2006.01)

(52) U.S. Cl. ..... 215/228; 215/218; 215/253

(58) Field of Classification Search ..... 215/228, 215/201–227, 250–254
See application file for complete search history.

(56) References Cited

U.S. PATENT DOCUMENTS 3,504,818 A * 4/1970 Crisci ..... 215/252
3,744,655 A 7/1973 Nixdoriff, Jr.
3,857,508 A * 12/1974 LaBarge et al. ..... 215/221
3,954,200 A * 5/1976 Willis ..... 215/44
4,281,771 A 8/1981 Siegel
4,326,639 A * 4/1982 Stahl et al. ..... 215/252
4,337,869 A 7/1982 Guinle
4,345,690 A 8/1982 Hopley
4,346,809 A 8/1982 Kusz
4,433,789 A 2/1984 Gibilisco
4,534,480 A * 8/1985 Santostasi et al. ..... 215/252
4,567,991 A 2/1986 Anderson
4,609,115 A * 9/1986 Moore et al. ..... 215/252
4,771,904 A * 9/1988 Perne et al. ..... 215/252
4,930,647 A * 6/1990 Dutt et al. ..... 215/252
5,027,964 A * 7/1991 Banich, Sr. ..... 215/252
5,040,692 A * 8/1991 Julian ..... 215/252
5,111,947 A * 5/1992 Patterson ..... 215/256
5,115,928 A 5/1992 Drummond, Jr.
5,213,223 A 5/1993 Minnette
5,246,123 A 9/1993 Kramer et al.
5,579,934 A 12/1996 Buono
5,673,808 A * 10/1997 Valyi et al. ..... 215/252
5,769,252 A 6/1998 Volpe
5,873,475 A 2/1999 Volpe
5,899,348 A 5/1999 Konefal et al.
5,927,527 A * 7/1999 Montgomery et al. ..... 215/219
5,979,680 A 11/1999 Farside
5,992,657 A * 11/1999 Friedman ..... 215/209
6,016,930 A 1/2000 Mathes et al.
6,039,196 A 3/2000 Ekkert et al.
6,053,343 A 4/2000 Krueger
6,176,381 B1 1/2001 Mader
6,202,876 B1 3/2001 DeJonge
6,439,409 B1 8/2002 Dressel et al.
6,446,823 B2 9/2002 Miceli et al.

(Continued)

*Primary Examiner*—Lien T Ngo
(74) *Attorney, Agent, or Firm*—Reising Ethington P.C.

(57) ABSTRACT

A closure includes a one-piece integrally molded plastic shell having a shell portion that is engageable with a container such that said closure is adapted to function in cooperation with the container in a first predetermined mode of operation, such as a child-resistant mode of operation. The shell portion is selectively removable by a user such that the closure is then adapted to function in cooperation with the container in a second predetermined mode of operation different from said first mode of operation, such as a non-child-resistant mode of operation.

10 Claims, 1 Drawing Sheet

U.S. PATENT DOCUMENTS

| | | | |
|---|---|---|---|
| 6,450,352 | B1 | 9/2002 | DeJonge |
| 6,523,709 | B2 | 2/2003 | Miceli et al. |
| 6,561,370 | B1 | 5/2003 | Escobar-Harrity |
| 6,848,590 | B2 | 2/2005 | Brozell et al. |
| 2001/0035388 | A1 | 11/2001 | Miceli et al. |
| 2002/0027119 | A1 | 3/2002 | Miceli et al. |
| 2002/0027120 | A1 | 3/2002 | Miceli et al. |
| 2002/0195412 | A1 | 12/2002 | Miceli et al. |
| 2003/0075519 | A1 | 4/2003 | Miceli et al. |
| 2003/0121877 | A1 | 7/2003 | Brozell et al. |
| 2004/0226907 | A1 | 11/2004 | Miceli et al. |

* cited by examiner

CLOSURE HAVING USER-MODIFIABLE FUNCTIONALITY

The present invention is directed to plastic closures, and more particularly to a closure that can be modified by a user to change the functionality of the closure. In the specific embodiment disclosed, for example, the closure can be modified by a user from child-resistant to non-child-resistant operation.

BACKGROUND AND SUMMARY OF THE INVENTION

It is a general object of the present invention to provide a plastic closure that can be modified by a user to alter its functionality or mode of operation.

A closure in accordance with one aspect of the invention includes a one-piece integrally molded plastic shell having a shell portion that is engageable within a container such that the closure is adapted to function in cooperation with the container in a first predetermined mode of operation. The shell portion is selectively removable by a user so that the closure is adapted to function in cooperation with the container in a second predetermined mode of operation different from the first mode of operation. In the disclosed embodiment of the invention the shell portion is frangibly connected to the shell and includes structure that is cooperable with the container in a child-resistant mode of operation. Removal of the shell portion by a user thus converts the closure for operation in a non-child-resistant mode of operation.

In accordance with a second aspect of the invention, there is provided a method of making a closure that is adapted to be converted by a user between first and second differing modes of operation in cooperation with a container. A one-piece integrally molded closure shell is provided with a portion frangibly connected to the shell, such as a band having child-resistance structure frangibly connected to the shell. The portion is adapted to cooperate with a container to operate in a first mode of operation—e.g., a child-resistant mode of operation—and the closure shell is adapted to cooperate with the container in a second mode of operation—e.g., a non-child-resistant mode of operation—when the portion is removed by a user.

BRIEF DESCRIPTION OF THE DRAWINGS

The invention, together with additional objects, features, advantages and aspects thereof, will be best understood from the following description, the appended claims and the accompanying drawings, in which:

DETAILED DESCRIPTION OF PREFERRED EMBODIMENTS

Figure 1:
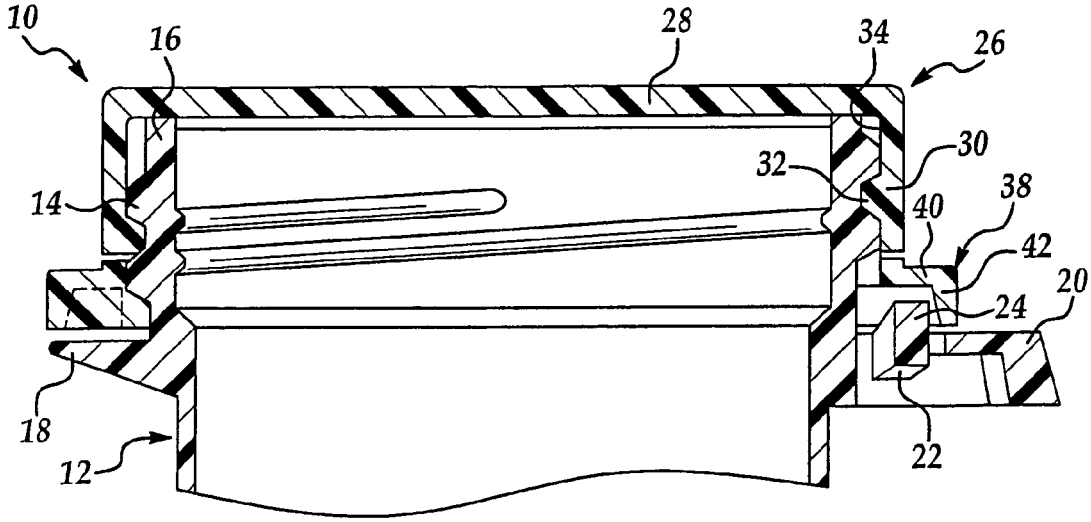
FIG. 1 is a cross-sectional view of a child-resistant package according to one exemplary embodiment of the present invention.

FIG. 1 illustrates a child-resistant package 10 that is substantially similar to that disclosed in U.S. Pat. No. 5,899,348, except for the inventive features of the present invention, which will be described in detail below. U.S. Pat. No. 5,899,348 is assigned to the assignee hereof and is incorporated by reference herein. The child-resistant package 10 includes a cylindrical plastic vial or container 12 which has one or more surface manifestations or external threads 14 on a finish 16, and optionally has a radial flange 18 below the threads 14. The present invention discloses the use of threads 14, but it is contemplated that any surface manifestations may be used, including bayonet features and the like. A child-resistant element, such as a deflectable tab or release element 20, is formed on the container 12, preferably at a circumferential interruption or space in the radial flange 18. The deflectable release element 20 includes an integral cantilevered stop element or lug 22 that extends axially upwardly from the release element 20. The cantilevered lug 22 also extends generally circumferentially in the same direction as a downward-threading spiral direction of the threads 14, and terminates in an axial stop surface 24. As defined herein, threading and unthreading generally corresponds to the terms applying and removing, and more specifically corresponds to the terms rotating, pulling, and the like.

Figure 2:
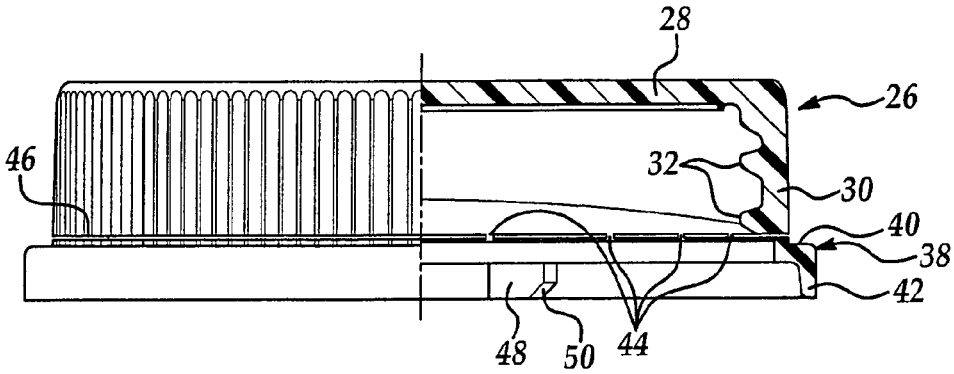
FIG. 2 is a partial cross-sectional view of a closure of the child-resistant package of FIG. 1.
Figure 3:
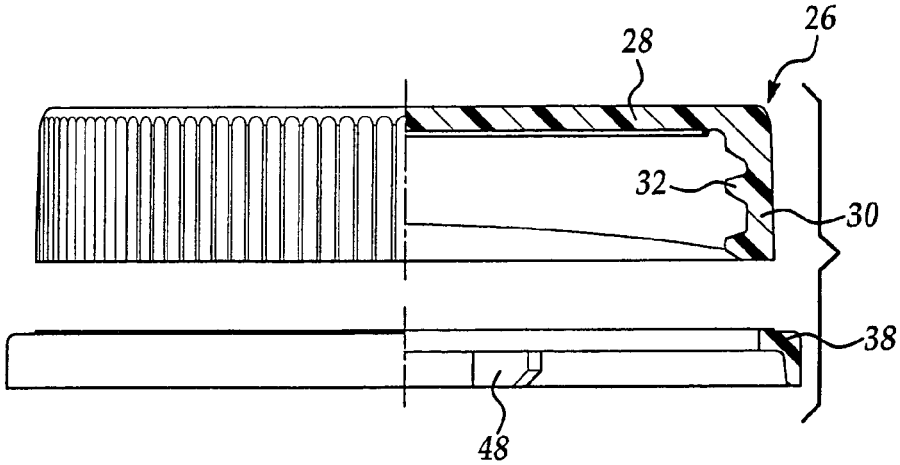
FIG. 3 is an exploded partial cross-sectional view of the closure of FIG. 2.

Referring to FIGS. 1-3, the child-resistant package 10 further includes a plastic closure 26. Closure 26 in the illustrated embodiment includes a one-piece integrally molded shell having a base wall 28 and a skirt 30 with one or more internal manifestations or threads 32. The axial edge of skirt 30 is integrally connected—i.e., as molded—to a band 38. This integral connection is a frangible connection, such as by a frangible web or a circumferential array of frangible bridges 44. A child-resistant element, such as a locking lug 48, extends axially downwardly from the ledge 40 of band 38 and radially inwardly from the band skirt 42. More than one locking lug 48 may be provided, but the quantity preferably corresponds to the quantity of threads on the container finish and closure skirt. The locking lug 48 also includes a chamfered surface 50 to facilitate application of the closure 26 to the container 12.

Closure 26 is applied to container 12 by downwardly rotating the closure over the finish 16 of the container 12 so as to engage the threads 32 of the closure 26 with the threads 14 of the container 12. Before the closure 26 abuts the finish 16 of the container 12, the locking lug 48 traverses freely over the cantilevered lug 22 and deflects the cantilevered lug 22 downwardly in the process. Once the locking lug 48 has deflected and passed over the cantilevered lug 22, the cantilevered lug 22 snaps back to its original upwardly extending orientation. Thus, if one attempts to open the child-resistant package by rotating the closure 26 in an unscrewing or upward threading direction, the locking lug 48 will confront the axial stop surface 24 of the cantilevered lug 22 and thereby prevent the closure 26 from rotating any further. Accordingly, the closure 25 will not be removable from the container 12, unless the child-resistant feature is defeated. The child-resistant feature of the present invention may be temporarily defeated by first depressing the release element 20 with a user's thumb or finger. Depressing the release element 20 in a radially inward and axially downward direction tends to pull the cantilevered lug 22 in an axial direction out of engagement or confrontation with the locking lug 48 of the closure 25. Once this is done, the closure 25 may be further rotated in the upward threading direction until the threads 32 of the closure 25 disengage from the threads 14 of the container 12 to remove the closure 26 and thereby open the container 12.

There are, however, circumstances in which it may be desired permanently to defeat the child-resistant feature of the present invention, such that the child-resistant package 10 is converted to a non-child-resistant package. In other words, the child-resistant package 10 is capable of operating in two modes: a child-resistant mode as originally provided and a non-child-resistant mode as modified. The child-resistant feature may be permanently defeated by removing or separating the band 38 from the skirt 30 of the closure 26, with the closure removed from the container, as depicted in the exploded view of FIG. 3. After the band is removed or separated from the closure 26, the closure 26 will function in a non-child-resistant manner. Referring to FIG. 2, the band 38 may be separated from the skirt 30 of the closure 26 in any desired manner. For example, in one method, the band 38 may be separated by removing the closure 26 from the container 12, gripping the base wall 28 and/or skirt 30 with one hand, gripping the band 38 with another hand, and pulling in opposite directions to break the frangible bridges 44 and thereby separate or remove the band 38 from the closure shell. Band 38 may also be severed from the shell.

There has thus been disclosed a closure, a closure and container package, and a method of manufacture that satisfy all of the objects and aims previously set forth. The present invention has been disclosed in conjunction with one exemplary embodiment thereof, and a number of modifications and variations have been discussed. Other modifications and variations will readily suggest themselves to persons of ordinary skill in the art in view of the foregoing description. For example, the invention has been disclosed in conjunction with a one-piece closure. However, additional closure elements, such as liners or other sealing elements, can be provided without departing from the disclosure. Furthermore, the invention has been disclosed in conjunction with converting a child-resistant closure to a non-child-resistant closure; however other implementations are contemplated. Indeed, the invention is intended to embrace all modifications and variations as fall within the spirit and broad scope of the appended claims.

The invention claimed is:

1. A child-resistant package that includes:

a container having a finish with a first engagement element, and a closure on said finish having a skirt with a second engagement element engagable with said first engagement element in a child-resistant mode of operation, said closure, including a portion of said skirt on which said second engagement element is disposed, including a shell of one-piece integrally molded plastic construction that is selectively removable from said container, and wherein said portion of said skirt on which said second engagement element is disposed is selectively permanently removable from said closure shell, with said closure removed from said container, to remove said second engagement element from said closure and thereby permanently convert said closure for non-child-resistant mounting on said container.

2. The package set forth in claim 1 wherein said closure shell has a base wall and said finish has an open end, wherein said first engagement element on said finish is spaced from said open end and said second engagement element on said closure skirt is spaced from said base wall, and wherein said finish includes a third engagement element between said first engagement element and said open end, and said closure includes a fourth engagement element between said second engagement element and said base wall for engaging said third engagement element in said non-child-resistant mode of operation with said skirt portion removed from said closure shell.

3. The package set forth in claim 2 wherein said first and second engagement elements comprise lugs on said finish and said closure skirt portion respectively.

4. The package set forth in claim 3 wherein said third and fourth engagement elements comprise threads on said finish and said closure skirt respectively.

5. The package set forth in claim 1 wherein said portion of said skirt is frangibly connected to the remainder of said closure shell.

6. A method of converting a child-resistant package to a non-child-resistant mode of operation, which includes the steps of:

(a) providing a child-resistant package that includes a container having a finish with a first engagement element, and a closure on said finish, said closure including a shell of one-piece integrally molded plastic construction having a skirt with a second engagement element engagable with said first engagement element in a child-resistant mode of operation, (b) removing said closure in its entirety from said container finish, and (c) permanently removing from said closure a portion of said skirt on which said second engagement element is disposed, with said closure removed from said container, to remove said second engagement element from said closure and thereby permanently convert said closure for non-child-resistant mounting on said container.

7. The method set forth in claim 6 wherein said step (a) is such that said closure shell has a base wall, a first skirt portion adjacent to said base wall and a second skirt portion remote from said base wall on which said second engagement element is disposed, said second skirt portion being frangibly coupled to said first skirt portion such that said second skirt portion is permanently frangibly removable from said first skirt portion in said step ©).

8. The method set forth in claim 6 wherein said step (a) is such that said closure shell has a base wall and said finish has an open end, said first engagement element on said finish is spaced from said open end and said second engagement element on said closure skirt is spaced from said base wall, and said finish includes a third engagement element between said first engagement element and said open end, and said closure includes a fourth engagement element between said second engagement element and said base wall for engaging said third engagement element in said non-child-resistant mode of operation with said skirt portion removed from said closure shell.

9. The method set forth in claim 8 wherein said step (a) is such that said first and second engagement elements comprised lugs on said finish and said closure skirt portion respectively.

10. The method set forth in claim 9 wherein said step (a) is such that said third and fourth engagement elements comprised threads on said finish and said closure skirt respectively.

* * * * *